US005288602A

United States Patent [19]

Geiger et al.

[11] Patent Number: 5,288,602

[45] Date of Patent: Feb. 22, 1994

[54] PHOTOGRAPHIC SILVER HALIDE ELEMENT CONTAINING SILICONE OIL

[75] Inventors: Markus Geiger, Langenfeld; Hans-Horst Steinbach, Lindlar, both of Fed. Rep. of Germany

[73] Assignee: Agfa-Gevaert Aktiengesellschaft, Leverkusen, Fed. Rep. of Germany

[21] Appl. No.: 104,992

[22] Filed: Aug. 10, 1993

[30] Foreign Application Priority Data

Aug. 24, 1992 [DE] Fed. Rep. of Germany ..... 4228003

[51] Int. Cl.[5] ..... G03C 1/76

[52] U.S. Cl. ..... 430/539; 430/523; 430/531; 430/950; 430/961

[58] Field of Search ..... 430/523, 531, 539, 950, 430/961

[56] References Cited

U.S. PATENT DOCUMENTS

| | | | |
|---|---|---|---|
| 4,109,449 | 2/1980 | Naoi et al. | 430/539 |
| 4,495,273 | 1/1985 | Pannocchia | 430/539 |
| 5,206,127 | 4/1993 | Ishigaki et al. | 430/539 |
| 5,208,139 | 5/1993 | Ishigaki | 432/539 |

*Primary Examiner*—Jack P. Brammer
*Attorney, Agent, or Firm*—Connolly and Hutz

[57] ABSTRACT

A photographic recording material which contains a support and thereupon at least one light-sensitive silver halide emulsion layer together with a protective layer containing gelatine over the light-sensitive layer and optionally a layer on the reverse side containing gelatine, and the protective layer containing gelatine and/or the reverse side layer containing gelatine contains a silicone oil of the formula I

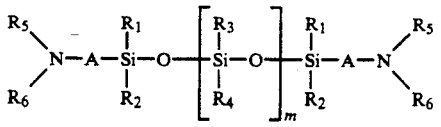

(I)

in which $R_1$ means hydroxy, alkoxy, cycloalkoxy, aryloxy, $R_2$ means a residue of the formula

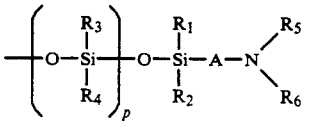

or $R_1$ $R_3$, $R_4$ means alkyl, aryl, cycloalkyl, $R_5$, $R_6$ means H, alkyl, aminoalkyl, polyaminoalkyl, A means a straight-chain or branched alkene residue with 3 to 20 C atoms, wherein there is between the Si atom and the N atom a carbon chain of at least 3 C atoms, m means 10 to 1000 and p means 1 to 350 and is hardened, distinguished by equally good coefficients of static friction and sliding friction before and after processing and by constantly good dry scratch resistance.

7 Claims, No Drawings

PHOTOGRAPHIC SILVER HALIDE ELEMENT CONTAINING SILICONE OIL

The invention relates to a photographic recording material with improved surface properties.

Photographic recording materials customarily consist of a support to which are applied at least one light-sensitive silver halide emulsion layer and, on top of this, at least one protective layer. The binder customarily used for the silver halide granules is gelatine, which is hardened with an appropriate hardening agent so that the photographic materials may be processed after exposure even at temperatures in excess of 30° C.

Photographic materials are generally available as roll goods or stacked individual sheets. In both cases, it is required that the coefficient of static friction and sliding friction is of an optimum value, which should as far as possible be identical before and after processing. If these coefficients are too low, i.e. if surface slip is too great, it is not possible to form exact stacks; the individual sheets slide away from each other. Correspondingly, rolls do not form flush sides, which leads to problems on the pouring line after drying, during conversion, during use in developing machinery, cameras etc. If these coefficients are too high, then the sheets adhere too strongly to each other or, in the case of rolls, excessive force must be used for unrolling, which leads to static discharges and sparking, to tears in the material and to faults in the transport mechanisms of developing machinery or cameras. If an initially optimally adjusted coefficient is degraded by processing, then the same problems arise with the product of processing.

For these reasons, a lubricant, for example dialkyl silicones or paraffins, is customarily added to the outermost layers of a photographic material. While these products do indeed improve the coefficients of static friction and sliding friction, the coefficients do not remain sufficiently constant through processing.

The object of the invention was thus to provide a photographic material which has optimally adjusted coefficients of sliding friction and static friction which change as minimally as possible during processing.

Static friction is understood to be the friction which must be overcome in order to make the material slide from rest, and sliding friction to be the friction during sliding.

Surprisingly, this object may be achieved by incorporating into at least one of the outer layers of the photographic material, which layer contains gelatine, a silicone oil of the formula I

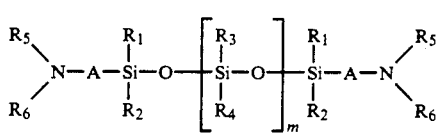

(I)

in which $R_1$ means hydroxy, alkoxy, cycloalkoxy, aryloxy, $R_2$ means a residue of the formula

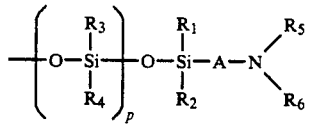

or $R_1$ $R_3$, $R_4$ means alkyl, aryl, cycloalkyl, $R_5$, $R_6$ means H, alkyl, aminoalkyl, polyaminoalkyl, A means a straiqht-chain or branched alkene residue with 3 to 20 C atoms, wherein there is between the Si atom and the N atom a carbon chain of at least 3 C atoms, m means 10 to 1000, preferably 50 to 200, p1 means 1 to 350, preferably 10 to 100, and hardening the layer.

The invention therefore provides a photographic recording material which contains a support and thereupon at least one light-sensitive silver halide emulsion layer together with a protective layer over the light-sensitive layer and optionally a layer on the reverse side, wherein the protective layer and/or reverse side layer contains gelatine, characterised in that the protective layer containing gelatine and/or the reverse side layer containing gelatine contains a silicone oil of the formula I and is hardened.

Preferably, the silicone oil in the protective layer is used over at least one light-sensitive layer. This protective layer contains in particular 0.2 to 2 g of gelatine per $m^2$. The silicone oil is used in particular in an amount of 1 to 100 mg/$m^2$, preferably 2 to 20 mg/$m^2$.

All common hardeners may be used, for example triazine hardeners, vinyl sulphone hardeners, but in particular so-called instant hardeners.

The coefficient of sliding friction is determined as follows:

Measurement is made pursuant to DIN 53 375. The test piece is applied with the coated (or reverse) side under a sled (mass 450 g; supporting surface 6×4 cm) and placed on the coated side of a sample of the same material. Force is applied to the sled via a spring. The sliding friction is the force which remains effective immediately after overcoming the static friction at the specified sliding speed of 10 mm/s over a distance of 135 mm with a contact time until the beginning of measurement of 10 s. The coefficient of sliding friction is calculated from the sliding friction force and the standard force.

The coefficient of sliding friction should be between 0.3 and 0.4 before and after processing of the material.

The coefficient of static friction is determined in a manner analogous to the measurement of the coefficient of sliding friction and is the initial value of the measurement.

Measurements are made under dust-free conditions in a clean-room at 23° C. and 55% relative humidity.

The coefficient of static friction should also be between 0.3 and 0.4 before and after processing.

Preferably, in formula I $R_1$ means $C_1$ to $C_4$ alkoxy, $R_2$ means $C_1$ to $C_4$ alkoxy or a residue of the formula,

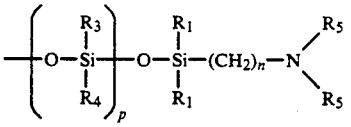

$R_3$, $R_4$ means $C_1$ to $C_4$ alkyl, in particular $CH_3$ or $C_2H_5$ $R_5$, $R_6$ mean hydrogen, $C_1$ to $C_4$ alkyl, cyclohexyl, phenyl, a residue $—CH_2—CH_2—NH_2$ or a residue $—(CH_2—CH_2—NH)_q—CH_2—CH_2—NH_2$ m means 50 to 200, n means 3 to 8, p means 30 to 150 and q means 1 to 8.

Suitable compounds of formula I are for example

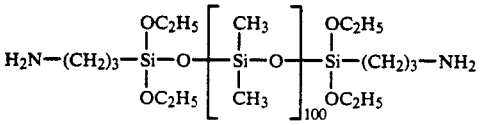

A 1

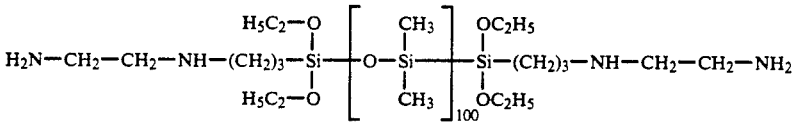

A 2

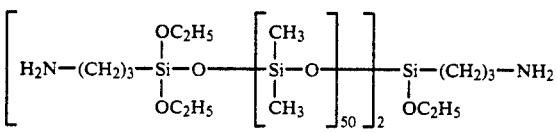

A 3

The silicone oil may be applied together with the gelatine of the protective layer.

The gelatine layer may, however, also be poured first and then the silicone oil may be applied on top, optionally with the hardener solution.

In particular, the silicone oils are applied in the form of an aqueous emulsion, wherein such an emulsion consists, for example, of 35 wt.% silicone oil, 3 wt.% emulsifier and 62 wt.% water. Suitable emulsifiers are anionic (e.g. sodium lauryl sulphate), non-ionic (e.g. octyl polyglycol ethers) or cationic (e.g. cetyl ammonium bromide) emulsifiers.

Dry scratch resistance is determined by guiding a diamond with a point angle of 90° and a point radius of 76 μm across the surface of the material under an increasing perpendicular force. The force at which the first visible damage to the layer occurs is stated.

The photographic material may be a black and white or colour material.

Examples of colour photographic materials are colour negative films, colour reversal films, colour positive films, colour photographic paper, colour reversal photographic paper, colour sensitive materials for the colour diffusion transfer process or the silver colour bleaching process.

Suitable supports for the production of colour photographic materials are, for example, films and sheets of semi-synthetic and synthetic polymers, such as cellulose nitrate, cellulose acetate, cellulose butyrate, polystyrene, polyvinyl chloride, polyethylene terephthalate and polycarbonate and paper laminated with a barytes layer or an α-olefin polymer layer (for example polyethylene). These supports may be coloured with dyes and pigments, for example titanium dioxide. They may also be coloured black in order to provide light shielding. The surface of the support is generally subjected to a treatment in order to improve the adhesion of the photographic emulsion layer, for example to a corona discharge with subsequent application of a substrate layer.

Colour photographic materials customarily contain at least one layer of each of a red-sensitive, green-sensitive and blue-sensitive silver halide emulsion layer, optionally together with interlayers and protective layers.

Essential constituents of the photographic emulsion layers are the binder, silver halide granules and colour couplers.

Preferably, gelatine is used as the binder. Gelatine may, however, be entirely or partially replaced with other synthetic, semi-synthetic or also naturally occurring polymers. Synthetic gelatine substitutes are, for example, polyvinyl alcohol, poly-N-vinyl pyrrolidone polyacrylamides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkyl cellulose, carboxymethyl cellulose and phthalyl cellulose together with gelatine derivatives obtained by reaction with alkylating or acylating agents or by grafting polymerisable monomers, are examples of such products.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. Oxidised gelatine may also be used. The production of such gelatines is described, for example, in *The Science and Technology of Gelatine*, edited by A. G. Ward and A. Courts, Academic Press 1977, pages 295 et seq. The gelatine used in each case should have a content of photographically active impurities which is as low as possible (inert gelatine). Gelatines with high viscosity and lower swelling are particularly advantageous.

The silver halide present in the photographic material as the light-sensitive constituent may contain chloride, bromide or iodide or mixtures thereof as the halide. For example, the halide content of at least one layer may consist of 0 to 15 mol% iodide, 0 to 100 mol% chloride and 0 to 100 mol% bromide. In the case of colour negative and colour reversal films, silver bromide-iodide emulsions are customarily used, in the case of colour negative and colour reversal paper, silver chloride-bromide emulsions with a high chloride content up to pure silver chloride emulsions are customarily used. The crystals may be predominantly compact, for example regularly cubic or octahedral or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals, in which the ratio of diameter to thickness is substantially greater than 5:1 for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains do not deviate by more than ±30% from the average grain size. The emulsions may, in addition to the silver halide, also contain organic silver salts, for example silver benzotriazolate or silver behenate.

Two or more types of silver halide emulsions which are produced separately may be used as a mixture.

During precipitation of the silver halides and/or the physical ripening of the silver halide grains, salts or complexes of metals, such as Cd, Zn, Pb, Tl, Bi, Ir, Rh, Fe may also be present.

Moreover, precipitation may also proceed in the presence of sensitising dyes. Complexing agents and/or dyes may be made ineffective at any desired point in time, for example by altering the pH value or by an oxidative treatment.

On completion of crystal formation, or also at an earlier point in time, the soluble salts are eliminated from the emulsion, for example by noodling and washing, by flocculation and washing, by ultrafiltration or by ion exchangers.

The silver halide emulsion is generally subjected to chemical sensitisation under defined conditions—pH, pAg, temperature, gelatine concentration, silver halide concentration and sensitiser concentration—until the optimum sensitivity and fog are achieved. The procedure is described in, for example, H. Frieser, *Die Grundlagen der Photographischen Prozesse mit Silberhalogeniden,* pages 675–734, Akademische Verlagsgesellschaft (1968).

At this stage, chemical sensitisation may proceed with the addition of compounds of sulphur, selenium, tellurium and/or compounds of metals of subgroup VIII of the periodic table (e.g. gold, platinum, palladium, iridium), furthermore there may be added thiocyanate compounds,. surface-active compounds, such as thioethers, heterocyclic nitrogen compounds (for example imidazoles, azaindenes) or also spectral sensitisers (described, for example, in F Hamer, *The Cyanine Dyes and Related Compounds,* 1964, or *Ullmanns Encyclopadie der technischen Chemie,* 4th edition, volume 18, pages 431 et seq, and *Research Disclosure* 17643 (Dec. 1978), section III). Alternatively or additionally, reduction sensitisation may be performed by adding reducing agents (tin-II salts, amines, hydrazine derivatives, aminoboranes, silanes, formamidinesulphinic acid), by hydrogen, by low pAg (for example, less than 5) and/or high pH (for example, greater than 8).

The photographic emulsions may contain compounds to prevent fogging or to stabilise the photographic function during production, storage or photographic processing.

Particularly suitable are azaindenes, preferably tetra and pentaazaindenes, particularly those substituted with hydroxyl or amino groups. Such compounds have been described, for example, by Birr, *Z. Wiss. Phot.,* 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, optionally substituted benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercaptopyrimidines, wherein these mercaptoazoles may also contain a water solubilising group, for example a carboxyl group or sulpho group. Further suitable compounds are published in *Research Disclosure* 17643 (Dec. 1978), section VI.

The stabilisers may be added to the silver halide emulsions before, during or after ripening of the emulsions.

Naturally, the compounds may also be added to other photographic layers which are assigned to a silver halide layer.

Mixtures of two or more of the stated compounds may also be used.

The photographic emulsion layers or other hydrophilic colloidal layers of the light-sensitive material produced according to the invention may contain surface-active agents for various purposes, such as coating auxiliaries, to prevent formation of electric charges, to improve sliding properties, to emulsify the dispersion, to prevent adhesion and to improve photographic characteristics (e.g. acceleration of development, greater contrast, sensitisation, etc.). Apart from natural surface-active compounds, for example saponin, it is mainly synthetic surface-active compounds (surfactants) which are used: non-ionic surfactants, for example alkene oxide compounds, glycerol compounds or glycidol compounds, cationic surfactants, for example higher alkylamines, quaternary ammonium salts, pyridine compounds and other heterocyclic compounds, sulphonium compounds or phosphonium compounds, anionic surfactants containing an acid group, e.g. carboxylic acid, sulphonic acid, a phosphoric acid, sulphuric acid ester or phosphoric acid ester group, ampholytic surfactants, for example amino acid and aminosulphonic acid compounds together with sulphuric or phosphoric acid esters of an amino alcohol.

The photographic emulsions may be spectrally sensitised by using methine dyes or other dyes. Particularly suitable dyes are cyanine dyes, merocyanine dyes and complex merocyanine dyes.

An overview of the polymethine dyes suitable as spectral sensitisers, the suitable combinations of the dyes and the combinations with supersensitising effects is contained in *Research Disclosure* 17643 (Dec. 1978), section IV.

In particular, the following dyes—classified by spectral range—are suitable:

1. as red sensitisers
   9-ethylcarbocyanines with benzothiazole, benzoselenazole or naphthothiazole as basic terminal groups, which may be substituted in 5th or 6th position by halogen, methyl, methoxy, carbalkoxy, aryl, together with 9-ethyl-naphthoxathia- or -selenocarbocyanines and 9-ethyl-naphthothiaoxa- or -benzoimidazocarbocyanines,.provided that the dyes bear at least one sulphoalkyl group on the heterocyclic nitrogen.
2. as green sensitisers
   9-ethylcarbocyanines with benzoxazole, naphthoxazole or a benzoxazole and a benzothiazole as basic terminal groups, together with benzimidazolecarbocyanines, which may also be further substituted and must also contain at least one sulphoalkyl group on the heterocyclic nitrogen.
3. as blue sensitisers
   symmetrical or asymmetrical benzimidiazo-, oxa-, thia-or selenocyanines with at least one sulphoalkyl group on the heterocyclic nitrogen and optionally further substituents on the aromatic ring, together with apomerocyanines with a rhodanine group.

Sensitisers may be dispensed with if the intrinsic sensitivity of the silver halide is sufficient for a specific spectral range, for example the blue sensitivity of silver bromides.

To the differently sensitised emulsion layers are assigned non-diffusing monomeric or polymeric colour couplers which may be located in the same layer or in an adjacent layer. Usually, cyan couplers are assigned to the red-sensitive layers, magenta couplers to the green-sensitive layers and yellow couplers to the blue-sensitive layers.

Colour couplers to produce the cyan partial colour image are generally couplers of the phenol or α-naphthol type.

Colour couplers to produce the magenta partial colour image are generally couplers of the 5-pyrazolone, indazolone or pyrazoloazole type.

Colour couplers to produce the yellow partial colour image are generally couplers with an open-chain ketomethylene grouping, in particular couplers of the α-acylacetamide type; suitable examples of these couplers are α-benzoylacetanilide couplers and α-pivaloylacetanilide couplers.

The colour couplers may be 4-equivalent couplers, but they may also be 2-equivalent couplers. The latter are derived from 4-equivalent couplers by containing a substituent at the coupling position which is eliminated on coupling. 2 -equivalent couplers are considered to be those which are colourless, as well as those which have an intense intrinsic colour which on colour coupling disappears or is replaced by the colour of the image dye produced (mask couplers), and white couplers which, on reaction with colour developer oxidation products, give rise to substantially colourless products. 2-equivalent couplers are further considered to be those which contain an eliminable residue at the coupling position, which residue is liberated on reaction with colour developer oxidation products and so either directly or after one or more further groups are eliminated from the initially eliminated residue (for example, DE-A-27 03 145, DE-A-28 55 697, DE-A-31 05 026, DE-A-33 19 428), a specific desired photographic effect is produced, for example as a development inhibitor or accelerator. Examples of such 2-equivalent couplers are the known DIR couplers as well as DAR or FAR couplers.

DIR couplers, which release azole type development inhibitors, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages for colour reproduction, i.e. colour separation and colour purity, and for the reproduction of detail, i.e. sharpness and graininess, are to be achieved with such DIR couplers, which, for example, do not release the development inhibitor immediately as a consequence of coupling with an oxidised colour developer, but rather only after a further subsequent reaction, which is, for example, achieved with a time control group. Examples of this are described in DE-A-28 55 697, 32 99 671, 38 18 231, 35 18 797, in EP-A-0 157 146 and 0 204 175, in U.S. Pat. Nos. 4 146 396 and 4 438 393 and in GB-A-2 072 363.

DIR couplers which release a development inhibitor which is decomposed in the developer bath to substantially photographically inactive products are, for example, described in DE-A-32 09 486 and EP-A-0 167 168 and 0 219 713. By this means, trouble-free development and processing consistency is achieved.

When DIR couplers are used, particularly those which eliminate a readily diffusible development inhibitor, improvements in colour reproduction, for example a more differentiated colour reproduction, may be achieved by suitable measures during optical sensitisation, as is described, for example, in EP-A-0 115 304, 0 167 173, GB-A-2 165 058, DE-A-37 00 419 and U.S. Pat. No. 4 707 436.

The DIR couplers may, in a multi-layer photographic material, be added to the most various, for example also to light-insensitive layers or interlayers. Preferably, however, they are added to the light-sensitive silver halide emulsion layers, wherein the characteristic properties of the silver halide emulsion, for example its iodide content, the structure of the silver halide grains or its grain size distribution influence the photographic properties achieved. The influence of the released inhibitors may, for example, be restricted by the incorporation of an inhibitor catching layer according to DE-A-24 31 223. For reasons of reactivity or stability, it may be advantageous to use a DIR coupler which on coupling forms a colour in the layer in which it is accommodated, which is different from the colour to be produced in this layer.

In order to increase sensitivity, contrast and maximum density, principally DAR or FAR couplers may be used which eliminate a development accelerator or fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Pat. Nos. 4 618 572 and 4 656 123.

Reference is made to EP-A-193 389 as an example of the use of BAR couplers (bleach accelerator releasing coupler).

It may be advantageous to modify the effect of a photographically active group eliminated from a coupler by causing an intermolecular reaction of this group after its release with another group according to DE-A-35 06 805.

Since with the DIR, DAR or FAR couplers it is mainly the activity of the residue released on coupling that is desired and the colour-forming properties of these couplers are of lesser importance, those DIR, DAR or FAR couplers which give rise to substantially colourless products on coupling are also suitable (DE-A-5 47 640).

The eliminable residue may also be a ballast residue such that, on reaction with colour developer oxidation products, coupling products are obtained which are diffusible or have at least weak or restricted mobility (U.S. Pat. No. 4 420 556).

The material may, in addition to couplers, contain various compounds which, for example, may liberate a development inhibitor, an development accelerator, a bleach accelerator, a developer, a silver halide solvent, a fogging agent or an anti-fogging agent, for example so-called DIR hydroquinones and other compounds as, for example, described in U.S. Pat. Nos. 4 636 546, 4 345 024, 4 684 604 and in DE-A-31 45 640, 25 15 213, 24 47 079 and in EP-A-198 438. These compounds fulfil the same function as the DIR, DAR or FAR couplers, except that they produce no coupling products.

High-molecular weight colour couplers are, for example, described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4 080 211. The high-molecular weight colour couplers are generally produced by polymerisation of ethylenically unsaturated monomeric colour couplers. They may, however, also be obtained by polyaddition or polycondensation.

The incorporation of couplers or other compounds into the silver halide emulsion layers may proceed by initially producing a solution, dispersion or emulsion of the compound concerned and then adding it to the pouring solution for the layer concerned. Selection of the appropriate solvent or dispersant depends on the particular solubility of the compound.

Methods for the introduction of compounds which are essentially insoluble in water by a grinding process are described, for example, in DE-A-26 09 741 and DE-A-26 09 742.

Hydrophobic compounds may also be introduced into the pouring solution by using high-boiling solvents, so-called oil formers. Corresponding methods are described, for example, in U.S. Pat Nos. 2 322 027, 2 801 170, 2 801 171 and EP-A-0 043 037.

Instead of high-boiling solvents, oligomers or polymers, so-called polymeric oil formers, may be used.

The compounds may also be introduced into the pouring solution in the form of filled latices. Reference is, for example, made to DE-A-25 41 230, DE-A-25 41 274, DE-A-28 35 856, EP-A-0 014 921, EP-A-0 069 671, EP-A-0 130 115, U.S. Pat. No. 4 291 113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl-p-hydroxybenzoate, diethyldodecanamide, N-tetradecylpyrrolidone, isostearyl alcohol, 2,4-di-t-amylphenol, dioctyl acelate, glycerine tributyrate, iso-stearyl lactate, trioctyl citrate, N,N-dibutyl-2-butoxy-5-t-octyl aniline, paraffin, dodecyl benzene and diisopropylnaphthaline.

Each of the differently sensitised light-sensitive layers may consist of a single layer or may also comprise two or more partial layers of silver halide emulsion (DE-C-1 121 470). Here, red-sensitive silver halide emulsion layers are often located closer to the film support than green-sensitive silver halide emulsion layers and these in turn are closer than blue-sensitive layers, wherein there is generally a non light-sensitive yellow filter layer between the green-sensitive layers and the blue-sensitive layers.

In cases of suitably low intrinsic sensitivity of the green or red-sensitive layers, different layer arrangements may be selected, dispensing with the yellow filter layer, in which, for example, the blue-sensitive, then the red-sensitive and finally the green-sensitive layers follow each other on the support.

The non light-sensitive interlayers generally located between layers of different spectral sensitivity may contain agents which prevent an undesirable diffusion of developer oxidation products from one light-sensitive layer into another light-sensitive layer with a different spectral sensitisation.

Suitable agents, which are also known as scavengers or EOP catchers, are described in Research Disclosure 7 643 (Dec. 1978), section VII, 17 842 (Feb. 1979) and 18 716 (Nov. 1979), page 650 and in EP-A-0 069 070, 0 098 072, 0 124 877, 0 125 522.

If there are several partial layers of the same spectral sensitisation, then they may differ in composition, particularly in terms of the type and quantity of silver halide granules. In general, the partial layer with the greater sensitivity will be located further from the support than the partial layer with lower sensitivity. Partial layers of the same spectral sensitisation may be adjacent to each other or may be separated by other layers, for example layers of different spectral sensitisation. Thus, for example, all highly sensitive and all low sensitivity layers may be grouped together each in package of layers (DE-A-19 58 709, DE-A-25 30 645, DE-A-26 22 922).

The photographic material may also contain UV light absorbing compounds, optical whiteners, spacers, filter dyes, formaline catchers, light-protection agents, antioxidants, $D_{min}$ dyes, additives to improve stabilisation of dyes, couplers, Whiteners and to reduce colour fogging, plasticisers (latices), biocides and others.

UV light absorbing compounds are intended on the one hand to protect the colour dyes from bleaching by high-UV daylight and on the other hand to absorb the UV light in daylight on exposure and so improve the colour reproduction of a film. Customarily, compounds of different structure are used for the two tasks. Examples are aryl-substituted benzotriazole compounds (U.S. Pat. No. 3 533 794), 4-thiazolidone compounds (U.S. Pat. Nos. 3 314 794 and 3 352 681), benzophenone compounds (JP-A-2784/71), cinnamic acid ester compounds (U.S. Pat. Nos. 3 705 805 and 3 707 375), butadiene compounds (U.S. Pat No. 4 045 229) or benzoxazole compounds (U. S. Pat. No. 3 700 455).

Ultra-Violet absorbing couplers (such as cyan couplers of the α-naphthol type) and ultra-violet absorbing polymers may also be used. These ultra-violet absorbants may be fixed into a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes are particularly advantageously used.

Suitable optical whiteners are, for example, described in *Research Disclosure* 17 643 (Dec. 1978), section V, in U.S. Pat. Nos. 2 632 701, 3 269 840 and in GB-A-852 075 and 1 319 763.

Certain binder layers, in particular the layer furthest away from the support, but also occasionally interlayers, particularly if they constitute the layer furthest away from the support during manufacture, may contain photographically inert particles of an inorganic or organic nature, for example as flatting agents or spacers (DE-A-33 31 542, DE-A-34 24 893, *Research Disclosure* 17 643 (Dec. 1978), section XVI). The protective layer according to the invention preferably contains such spacers, in particular in an amount of 2 to 10 mg/m$^2$.

The average particle diameter of the spacers is in particular in the range from 0.2 to 10 μm, preferably in the range from 0.7 to 2.5 μm. The spacers are insoluble in water and may be soluble or insoluble in alkali, wherein the alkali-soluble spacers are generally removed from the photographic material in the alkaline developing bath.

Examples of suitable polymers are polymethyl methacrylate, copolymers of acrylic acid and methyl methacrylate together with hydroxypropylmethylcellulosehexahydrophthalate.

Additives to improve the stability of dyes, couplers and whiteners and to reduce colour fogging (*Research Disclosure* 17 643 (Dec. 1978), section VII) may belong to the following classes of chemical substances: hydroquinones, 6-hydroxychromanes, 5-hydroxycoumaranes, spirochromanes, spiroindanes, p-alkoxyphenols, sterically hindered phenols, gallic acid derivatives, methylene dioxybenzenes, aminophenols, sterically hindered amines, derivatives with esterified or etherified phenolic hydroxyl groups, metal complexes.

Compounds having both a sterically hindered amine partial structure and a sterically hindered phenol partial structure in one molecule (U. S. Pat. No. 4 268 593) are particularly effective in preventing the degradation of yellow colour images as a consequence of the development of heat, moisture and light. In order to prevent the degradation of magenta colour images, in particular their degradation due to the effects of light, spiroindanes (JP-A-159 644/81) and chromanes which are substituted by hydroquinone diethers or monoethers (JP-A-89 835/80) are particularly effective.

The layers of the photographic material according to the invention are hardened. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. Nos. 3 288 775, 2 732 303, GB-A-974 723 and GB-A-1 167 207), divinylsulphone compounds, 5-acetyl-1,3-diacryloylhexahydro-1,3,5-triazine and other compounds containing a reactive olefin bond (U.S. Pat. Nos. 3 635 718, 3 232 763 and GB-A-994 869); N-hydroxymethyl-phthalimide phthalimide and other N-methylol compounds (U.S. Pat. Nos. 2 732 316 and 2 586 168); isocyanates (U.S. Pat. No. 3 103 437); aziridine compounds (U.S. Pat Nos. 3 017 280 and 2 983 611); acid derivatives (U.S. Pat. Nos. 2 725 294 and 2 725 295); compounds of the carbodiimide type (U.S. Pat. No. 3 100 704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (JP-A-43353/81); N-sulphonyloximido compounds (U.S. Pat. No. 4 111 926), dihydroquinoline compounds (U. S. Pat. No. 4 013 468), 2-sulphonyloxypyridinium salts (JP-A-110 762/81), formamidinium salts (EP-A-0 162 308), compounds with two or more N-acycloximino groups (U.S. Pat. No. 4 052 373), epoxy compounds (U.S. Pat. No. 3 091 537), compounds of the isoxazole type (U. S. Pat. No. 3 321 313 and U.S. Pat. No. 3 543 292); ha)ogen carboxyaldehydes, such as mucochloric acid; dioxane derivatives, such as dihydroxydioxane and dichlorodioxane; and inorganic hardeners such as chrome alum and zirconium sulphate.

Hardening may be effected in a known manner by adding the hardener to the pouring solution for the layer to be hardened, or by overcoating the layer to be hardened with a layer containing a diffusible hardener.

There are included in the classes listed slow acting and fast acting hardeners as well as so-called instant hardeners, which are particularly advantageous. Instant hardeners are understood to be compounds which harden suitable binders in such a way that immediately after pouring, at the latest after 24 hours, preferably at the latest after 8 hours, hardening is concluded to such an extent that there is no further alteration in the sensitometry and swelling of the layered structure determined by the crosslinking reaction. Swelling is understood as the difference between the wet layer thickness and the dry layer thickness during aqueous processing of the film (*Photogr. Sci. Eng.* 8 (1964), 275; *Photogr. Sci. Eng.* (1972), 449).

These hardeners which react very rapidly with gelatine are, for example, carbamoylpyridinium salts, which enable the free carboxyl groups of the gelatine to react, so that the latter react with free amino groups of the gelatine to form peptide bonds crosslinking the gelatine.

The instant hardeners are preferably used in an amount of 0.to 3.0 g/m$^2$.

Suitable examples of instant hardeners are, for example, compounds of the general formulae

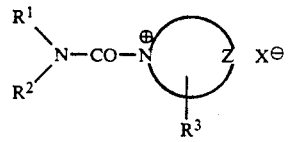

(a)

in which $R^1$ means alkyl, aryl or aralkyl, $R^2$ has the same meaning as $R^1$ or means alkene, arylene, aralkene or alkaralkene, wherein the second bond is made with a group of the formula

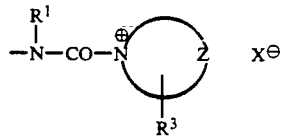

or $R^1$ and $R^2$ together mean the atoms required to complete an optionally substituted heterocyclic ring, for example a piperidine, piperazine or morpholine ring, wherein the ring may, for example, be substituted by $C_1$–$C_3$ alkyl or halogen, $R^3$ stands for hydrogen, alkyl, aryl, alkoxy, —$NR^4$—$COR^5$, —$(CH_2)_m$—$NR^8R^9$, —$(CH_2)_n$—$CONR^{13}R^{14}$ or $$-(CH_2)_p-\underset{\underset{R^{15}}{|}}{CH}-Y-R^{16}$$

or a bridge-type crosslink or a direct bond to a polymer chain, wherein $R^4$, $R^6$, $R^7$, $R^9$, $R^{14}$, $R^{15}$, $R^{17}$, $R^{18}$, and $R^{19}$ mean hydrogen or $C_1$–$C_4$ alkyl, $R^5$ means hydrogen, $C_1$–$C_4$ alkyl or $NR^6R^7$, $R^8$ means —$COR^{10}$ $R^{10}$ means $NR^{11}R^{12}$ $R^{11}$ means $C_1$–$C_4$ alkyl or aryl, particularly phenyl, $R^{12}$ means hydrogen, $C_1$–$C_4$ alkyl or aryl, particularly phenyl, $R^{13}$ means hydrogen, $C_1$–$C_4$ alkyl or aryl, particularly phenyl, $R^{16}$ means hydrogen, $C_1$–$C_4$ alkyl or aryl, —$COR^{18}$ or —$CONHR^{19}$, m means a number from 1 to 3 n means a number from 0 to 3 p means a number from 2 to 3

Y means O or $NR^{17}$ or $R^{13}$ and $R^{14}$ together represent the atoms required to complete an optionally substituted heterocyclic ring, for example a piperidine, piperazine or morpholine ring, wherein the ring may, for example, be substituted by $C_1$–$C_3$ alkyl or halogen, Z means the C atoms required to complete a 5 or 6 member aromatic heterocyclic ring, optionally with an anellated benzene ring, and $X^{\ominus}$ means an anion which is not present if an anionic group is already linked with the remainder of the molecule;

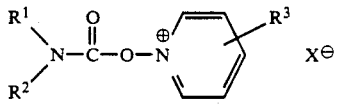

(b)

in which $R^1$, $R^2$, $R^3$ and $X^{73}$ have the meanings stated for formula (a).

There are diffusible hardeners which have the same hardening effect on all the layers in a layered structure. There are, however, also non-diffusing low molecular weight and high molecular weight hardeners the action of which is restricted within a layer. Using these, individual layers, for example the protective layer, may be particularly highly crosslinked. This is important if the silver halide layer is sparingly hardened in order to increase the silver covering power and the mechanical properties of the protective layer must be improved (EP-A-0 114 699).

Colour negative photographic materials are customarily processed by developing, bleaching, fixing and rinsing or by developing, bleaching, fixing and stabilising without subsequent rinsing, wherein bleaching and fixing may be combined into a single processing stage. Colour developer compounds which may be used are all developer compounds having the ability to react, in the form of their oxidation product, with colour couplers to azomethine or indophenol dyes. Suitable colour developer compounds are aromatic compounds containing at least one primary amino group of the p-phenylenediamine type, for example N,N-dialkyl-p-pheneylenediamines such as N,N-diethyl-p-phenylenediamine, 1-(N-ethyl-N-methanesulphoneamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Further colour developers which may be used are described for example in *J. Amer. Chem. Soc.* 73, 3106 (1951) and G. Haist *Modern Photographic Processing*, 1979, John Wiley & Sons, N.Y., pages 545 et seq.

An acid stop bath or rinsing may follow after colour development.

Customarily, the material is bleached and fixed immediately after colour development. Bleaches which may be used are, for example, Fe(III) salts and Fe(III) complex salts such as ferricyanides, dichromates, water soluble cobalt complexes. Iron-(III) complexes of aminopolycarboxylic acids are particularly preferred, in particular for example complexes of ethylenediaminetetraacetic acid, propylenediaminetetraacetic acid, diethylenetriaminepentaacetic acid, nitrilotriacetic acid, iminodiacetic acid, N-hydroxyethylethylenediaminetriacetic acid, alkyliminodicarboxylic acids and of corresponding phosphonic acids. Also suitable as bleaches are persulphates and peroxides, for example hydrogen peroxide.

Rinsing usually follows the bleaching-fixing bath or fixing bath, which is performed as countercurrent rinsing or consists of several tanks with their own water supply.

Favourable results may be obtained by using a subsequent finishing bath which contains no or only a little formaldehyde.

Rinsing may, however, be completely replaced with a stabilising bath, which is customarily performed countercurrently. If formaldehyde is added, this stabilising bath also performs the function of a finishing bath.

With colour reversal materials, there is an initial development with a black and white developer, the oxidation product of which is not capable of reacting with the colour couplers. There then follows a diffuse second exposure and then development with a colour developer, bleaching and fixing.

EXAMPLES

A colour photographic recording material was produced by applying the following layers to a paper coated on both sides with polyethylene. The quantities stated all relate to 1 $m^2$. The corresponding quantities of $AgNO_3$ are stated for the silver halide application.

EXAMPLE 1

Layer structure 1

1st layer (substrate layer)
0 2 g of gelatine

2nd layer (blue-sensitive layer)
blue-sensitive silver halide emulsion (99.5 mol% chloride, 0.5 mol% bromide, average grain diameter 0.78 μm) prepared from 0.50 g of $AgNO_3$ with
1.38 g of gelatine
0.60 g of yellow coupler Y-1
0.48 g of tricresyl phosphate (TCP)

3rd layer (interlayer)
8 g of gelatine
0.08 g of 2,5-dioctylhydroquinone
0.08 g of dibutyl phthalate (DBP)

4th layer (green-sensitive layer)
green-sensitised silver halide emulsion (99.5 mol% chloride, 0.5 mol% bromide, average grain size 0.45 μm) prepared from 0.40 g of $AgNO_3$ with
1.02 g of gelatine
0.37 g of magenta coupler M-1
0.40 g of DBP 5th layer (interlayer)
052 g of 2,5-dioctylhydroquinone
0.36 g of TCP 6th layer (redsensitive layer)
red sensitised silver halide emulsion (99.5 mol% chloride, 0.5 mol% bromide, average particle diameter 0.42 μm) prepared from 0.28 g of $AgNO_3$ with
0.84 g of gelatine
0.39 g of cyan coupler C-1
0.39 g of TCP 7th layer (UV protective layer)
0.65 g of gelatine
0.21 g of UV absorber as in 5th layer
0.11 g of TCP 8th layer (protective layer)
0.65 g of gelatine
0 39 g of hardener of the formula

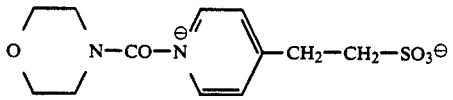

0.005 g of polymethyl methacrylate particles with a particle diameter of 1 μm

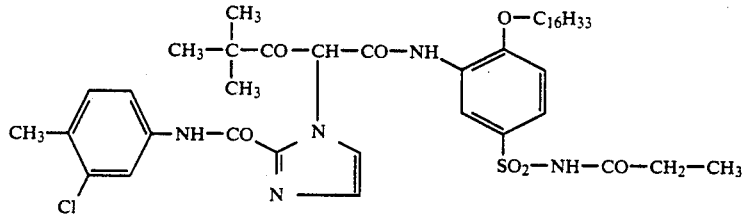

Y-1

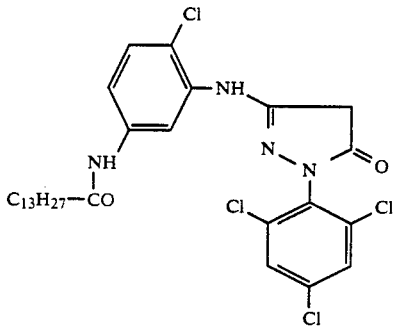

M-1

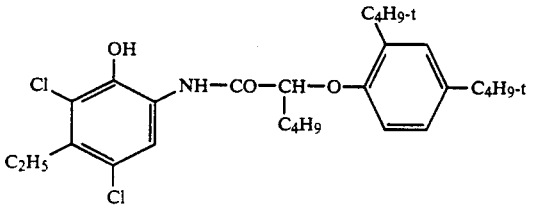

C-1

2 g of gelatine
0.66 g of UV absorber of the formula

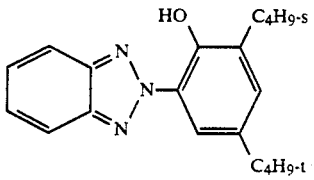

| Processing | |
|---|---|
| a) Colour developer - 45 s - 35° C. | |
| Triethanolamine | 9.0 g/l |
| N,N-diethylhydroxylamine | 4.0 g/l |
| Diethylene glycol | 0.05 g/l |
| 3-methyl-4-amino-N-ethyl-N-methane-sulphoneamidoethyl-aniline-sulphate | 5.0 g/l |
| Potassium sulphite | 0.2 g/l |
| Triethylene glycol | 0.05 g/l |
| Potassium carbonate | 22 g/l |
| Potassium hydroxide | 0.4 g/l |

-continued

| Processing | |
|---|---|
| Ethylenediaminetetraacetic acid di-Na salt | 2.2 g/l |
| Potassium chloride | 2.5 g/l |
| 1,2-dihydroxybenzene-3,4,6-trisulphonic acid-trisodium salt | 0.3 g/l |
| make up to 1000 ml with water; pH 10.0 | |
| b) Bleaching-fixing bath - 45 s - 35° C. | |
| Ammonium thiosulphate | 75 g/l |
| Sodium hydrogen sulphite | 13.5 g/l |
| Ammonium acetate | 2.0 g/l |
| Ethylenediaminetetraacetic acid (iron-ammonium salt) | 57 g/l |
| Ammonia, 25 wt. % | 9.5 g/l |
| Acetic acid | 9.0 g/l |
| make up to 1000 ml with water; pH 5.5 | |
| c) Rinsing - 2 min - 33° C. | |

EXAMPLES 2 to 11

These examples differ from example 1 by the fact that the 8th layer additionally contains the compounds stated in the following table.

The coefficient of sliding friction before and after processing, the coefficient of static friction before and after processing and the dry scratch resistance before and after processing were determined for the materials according to examples 1 and 11. The results are shown in Table 1.

| Example | Compound | Quantity mg/m$^2$ | Coeff. of sliding friction 1 | Coeff. of sliding friction 2 | Coeff. of static friction 1 | Coeff. of static friction 2 | Dry scratch resistance 1 | Dry scratch resistance 2 |
|---|---|---|---|---|---|---|---|---|
| 1 | — | — | 0.67 | 0.69 | 0.68 | 0.71 | 324 | 278 |
| 2 | V1 | 1.2 | 0.41 | 0.60 | 0.46 | 0.61 | 640 | 440 |
| 3 | V1 | 2.4 | 0.36 | 0.61 | 0.38 | 0.62 | 663 | 465 |
| 4 | V1 | 4.8 | 0.25 | 0.57 | 0.26 | 0.59 | 886 | 532 |
| 5 | A1 | 4 | 0.48 | 0.50 | 0.48 | 0.51 | 535 | 528 |
| 6 | A1 | 7 | 0.33 | 0.36 | 0.33 | 0.37 | 686 | 626 |
| 7 | A1 | 10 | 0.30 | 0.25 | 0.31 | 0.27 | 894 | 744 |
| 8 | A2 | 7 | 0.32 | 0.35 | 0.33 | 0.35 | 695 | 652 |
| 9 | V2 | 4 | 0.49 | 0.54 | 0.51 | 0.55 | 635 | 396 |
| 10 | V2 | 10 | 0.35 | 0.59 | 0.37 | 0.61 | 728 | 396 |
| 11 | V3 | 10 | 0.33 | 0.48 | 0.33 | 0.49 | 677 | 502 |

1: before processing
2: after processing
The coefficeints of sliding and static friction are dimensionless values.
Dry scratch resistance is stated in mN.

V 1 is a polydimethylsiloxane of the formula

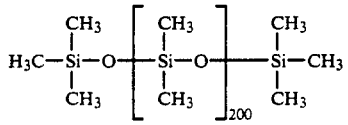

V 2 is a crosslinked dimethylsiloxane containing methoxy groups, produced by hydrolysis of the mixture:
52 g of trichloromonomethylsilane,
130 g of dimethyldichlorosilane,
22 g of trimethylmonochlorosilane
in xylene/methanol/water.

V 3 is a highly crosslinked methylsiloxane containing butoxy groups in xylene/butanol, produced by hydorlysis of the mixture:
840 g of trichloromonomethylsilane,
90 of dimethylomonochlorosilane,
14 g of trimethylmonochlorosilane
in xylene/butanol/water.

It can be seen that examples 5 to 8 according to the invention provide constant values for the coefficient of sliding friction, the coefficient of static friction and dry scratch resistance before and after processing, whereas the comparative tests are either at too low a level or, if there is a good value before processing, there is considerable deterioration after processing.

We claim:

1. A photographic recording material which contains a support and thereupon at least one light-sensitive silver halide emulsion layer together with a protective layer over the light-sensitive layer and optionally a layer on the reverse side, wherein the protective layer and/or reverse side layer contains gelatine, characterised in that the protective layer containing gelatine and/or the reverse side layer containing gelatine contains a silicone oil of the formula I

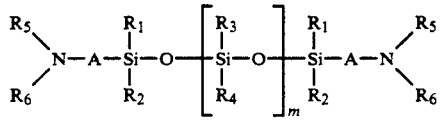

(I)

in which $R_1$ means hydroxy, alkoxy, cycloalkoxy, aryloxy, $R_2$ means a residue of the formula

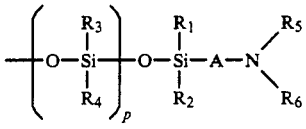

or $R_1$ $R_3$, $R_4$ means alkyl, aryl, cycloalkyl, $R_5$, $R_6$ means H, alkyl, aminoalkyl, polyaminoalkyl, A means a straight-chain or branched alkene residue with 3 to 20 C atoms, wherein there is between the Si atom and the N atom a carbon chain of at least 3 C atoms, m means 10 to 1000 and p means 1 to 350, and is hardened.

2. Photographic material according to claim 1, characterised in that the silicone oil of the formula I in the protective layer is used over the light-sensitive layer, of which there is at least one.

3. Photographic material according to claim 2, characterised in that the protective layer contains 0.2 to 2 g of gelatine per $m^2$ and the silicone oil in an amount of 1 to 100 $mg/m^2$.

4. Photographic material according to claim 1, characterised in that $R_1$ means $C_1$ to $C_4$ alkoxy, $R_2$ means $C_1$ to $C_4$ alkoxy or a residue of the formula,

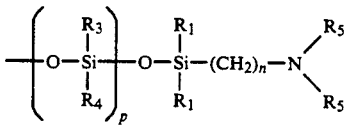

$R_3$, $R_4$ mean $C_1$ to $C_4$ alkyl, $R_5$, $R_6$ mean hydrogen, $C_1$ to $C_4$ alkyl, cyclohexyl or phenyl, a residue $—CH_2—CH_2—NH_2$ or a residue $—(CH_2—CH_2—NH)_q—CH_2—CH_2—NH_2$ A means $—9—CH_2—CH_2—)_n—$ m means 50 to 200, n means 3 to 8, p means 30 to 150 and q means 1 to 8.

5. Photographic material according to claim 1, characterised in that the protective layer and/or reverse side layer contain inert particles of an organic or inorganic nature.

6. Photographic material according to claim 5, characterised in that the inert particles have a particle diameter of 0.7 to 2.5 μm and are used in an amount of 1 to 10 $mg/m^2$.

7. Photographic material according to claim 1, characterised in that hardening is performed with an instant hardener.

* * * * *